United States Patent [19]

Barakitis et al.

[11] Patent Number: 4,959,589

[45] **Date of Patent: * Sep. 25, 1990**

[54] GLOW DISCHARGE STARTER HAVING DISCHARGE EXTINGUISHING MEANS

[75] Inventors: Nikolaos Barakitis, Salem; Sheppard Cohen, Danvers; Gregory Zaslavsky, Brookline, all of Mass.

[73] Assignee: GTE Products Corporation, Danvers, Mass.

[ * ] Notice: The portion of the term of this patent subsequent to Mar. 27, 2007 has been disclaimed.

[21] Appl. No.: 276,837

[22] Filed: Nov. 28, 1988

[51] Int. Cl.[5] ..... H01H 61/00

[52] U.S. Cl. ..... 315/58; 315/73; 337/22; 337/24

[58] Field of Search ..... 315/58, 59, 71, 73, 315/125, 290; 337/22–27, 362, 404; 361/105

[56] References Cited

U.S. PATENT DOCUMENTS 3,780,327 12/1973 Vervaart et al. ..... 337/22 X 3,887,847 6/1975 de Graaf et al. ..... 337/404 X 4,646,050 2/1987 Kling et al. ..... 337/22 X

*Primary Examiner*—Robert J. Pascal

*Attorney, Agent, or Firm*—Carlo S. Bessone

[57] ABSTRACT

This invention relates to a glow discharge starter including a glow bottle having a hermetically sealed discharge envelope containing an ionizable medium, a bimetallic electrode and a counter electrode. A pair of conductors extending from the main body of a radio frequency suppressing capacitor electrically coupling respective electrodes of the glow bottle. The main body of the capacitor is in a thermal relationship with the discharge envelope and responsive to heat generated therewithin. When a predetermined temperature limit is reached within the discharge envelope, the generated heat creates a short circuit within the main body of the capacitor and extinguishes the glow discharge. The present invention eliminates the need for an additional fuse member or thermal protector.

10 Claims, 2 Drawing Sheets

GLOW DISCHARGE STARTER HAVING DISCHARGE EXTINGUISHING MEANS

TECHNICAL FIELD

This invention relates in general to a glow discharge starter for an arc discharge lamp and more particularly to a glow discharge starter having means for short-circuiting the discharge path between the electrodes of the starter when a predetermined temperature limit is reached.

BACKGROUND OF THE INVENTION

A glow discharge starter is usually connected across or in parallel with an arc discharge lamp and includes a glow bottle containing a pair of electrodes. At least one of the electrodes comprises a bimetallic element which, when heated as a result of the glow discharge, bends towards the other electrode. When contact is made, the glow discharge ceases causing the bimetallic element to cool and withdraw from the contacted electrode. When contact is broken, a voltage pulse induced by the induction of the ballast, appears across the opposed electrodes of the lamp thereby initiating an arc discharge within the lamp. If the lamp ignition does not occur after the first voltage pulse, the glow discharge sequence is repeated until lamp ignition occurs. A radio frequency suppressing capacitor may be connected in parallel with the glow bottle.

A known glow discharge starter switch of the type mentioned above is described, for example, in U.K. Patent Specification No. 554,225. The starter contains a second bimetal device within the glow discharge starter switch which short-circuits the path between the main electrodes when a large quantity of heat has evolved in the glow discharge starter switch. This second bimetal device complicates the known glow discharge starter switch. This applies all the more because this second bimetal device is to be proportioned in such a manner that when it is closed the current flowing therethrough must also maintain this contact closed. A further drawback of this known device is that, due to its intricacy, its reliability is rather low.

U.S. Pat. No. 3,780,327, which issued to Vervaart et al on Dec. 18, 1973, discloses a glow discharge starter having a fuse arranged in thermal contact with the tubular part of the starter. A resilient member under mechanical pretension exerts a pulling force on the part of the fuse to be melted. As a result, the starter is rendered inoperative by the disconnection of electrical power. A drawback of this known glow discharge starter is that it is more complicated to manufacture and requires a special spring wire and low temperature solder which themselves require proper control.

U.S. Pat. No. 3,887,847, which issued to de Graaf et al on June 1, 1975, discloses a glow discharge starter which is provided with a device which creates a short circuit across the electrodes of the starter. The device consists of a pair of conductors from a capacitor which couples the electrodes of the starter and are separated by an auxiliary member consisting of an insulating material. The auxiliary member undergoes a permanent distortion at the maximum temperature limit. The disadvantage of this arrangement is that this device is more complicated to manufacture because it requires an additional step of shaping one or more of the conductors of the capacitor and/or it requires additional components, such as a spring wire or an insulating material.

SUMMARY OF THE INVENTION

It is therefore, an object of the present invention to obviate the disadvantages of the prior art.

It is another object of the present invention to provide an improved glow discharge starter which is relatively easy to manufacture.

It is another object of the present invention to provide an improved glow discharge starter which does not specifically require the use of a fuse wire, a second bimetal device or a separate thermal protector.

It is a further object of the present invention to provide an improved glow discharge starter which does not require additional components other than the glow bottle and capacitor.

These objects are accomplished, in one aspect of the invention, by the provision of a glow discharge starter comprising an hermetically sealed discharge envelope containing an ionizable medium, a bimetallic electrode and a counter electrode. Also included is a capacitor having a main body and a pair of conductors extending from the main body. The conductors electrically couple respective electrodes of the discharge envelope. The main body of the capacitor is in a thermal relationship with the discharge envelope to be responsive to heat generated in the discharge envelope. The capacitor is adapted to create a short circuit within the main body of the capacitor to thereby extinguish the discharge within the discharge envelope when a maximum temperature limit is reached.

In accordance with further aspects of the invention, the main body of the capacitor is separated from the discharge envelope by a distance not greater than about 0.020 inch.

In accordance with further teachings of the present invention, the main body of the capacitor and the discharge envelope are in a contiguous or nearly contiguous relationship.

In accordance with further embodiments of the invention, the capacitor has a mylar or silicon impregnated polypropylene dielectric.

In accordance with still further aspects of the present invention, the main body of the capacitor is longitudinally positioned with respect to the discharge envelope such that the center of the main body is in line with the main portion of the discharge.

In accordance with additional aspects of this invention, a method of making a glow discharge starter is provided. The method includes the steps of providing a discharge envelope, forming a bimetallic electrode with a bimetallic element and a post, providing a counter electrode, sealing the bimetallic electrode and the counter electrode within the envelope, exhausting the envelope, filling the envelope with a gas at a predetermined pressure, and hermetically sealing the envelope. The method further includes that step of providing a capacitor having a main body and a pair of conductors extending therefrom. Each of the conductors of the discharge envelope are connected to a respective conductor of the capacitor. The main body of the capacitor is positioned with respect to the discharge envelope so that the main body is responsive to heat generated in the discharge envelope to thereby create a short circuit and extinguish the discharge within the discharge envelope when a maximum temperature is reached.

BRIEF DESCRIPTION OF THE DRAWINGS

The invention will become more readily apparent from the following exemplary description in connection with the accompanying drawings, wherein.

BEST MODE FOR CARRYING OUR THE INVENTION

For a better understanding of the present invention, together with other and further objects, advantages and capabilities thereof, reference is made to the following disclosure and appended claims taken in conjunction with the above-described drawings.

Figure 1:
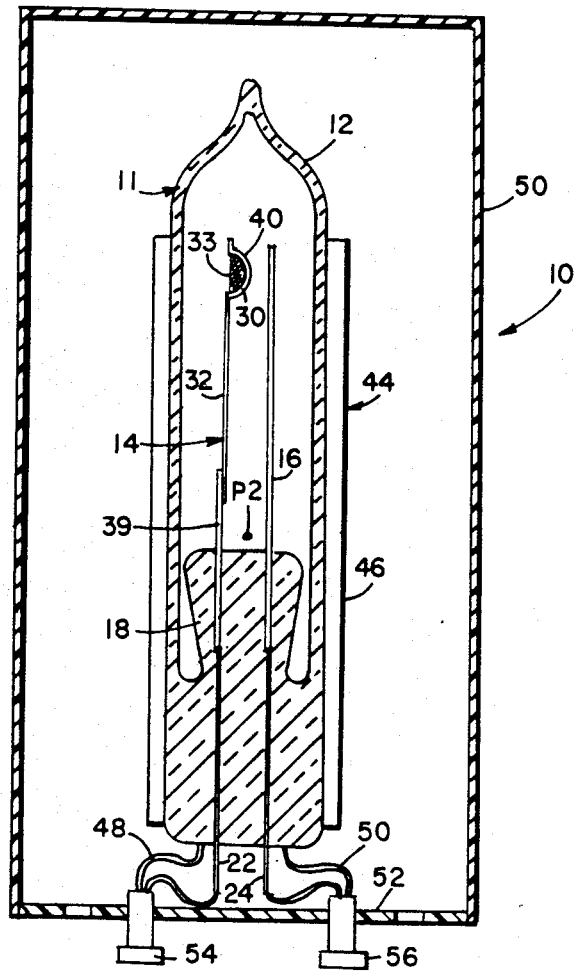
FIG. 1 is a front elevational view, partially in cross-section, of an embodiment of a glow discharge starter according to the invention including a discharge envelope, an associated capacitor, a bottom plate and a cover.
Figure 2:
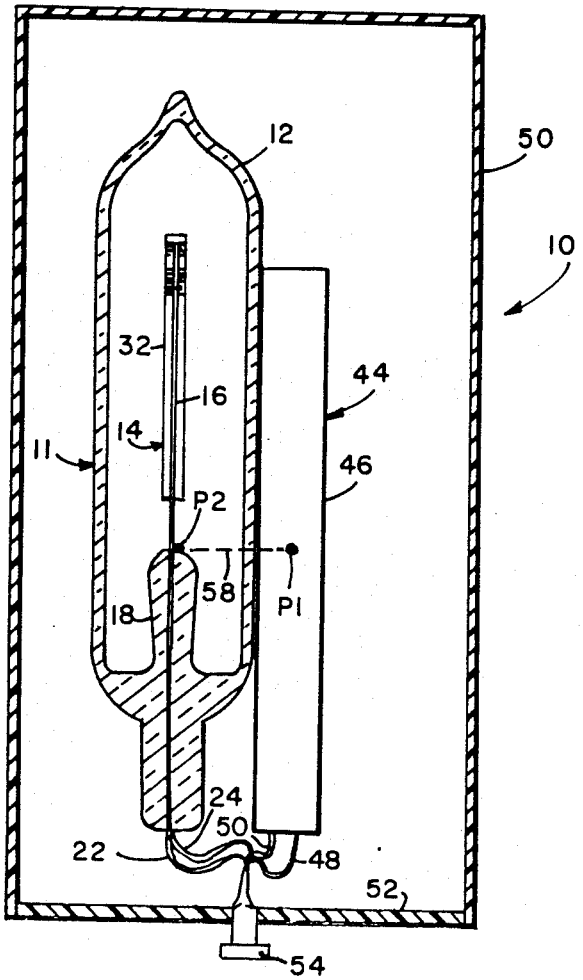
FIG. 2 is a side elevational view, partially in cross-section, of the glow discharge starter of FIG. 1.

Referring now to the drawings with greater particularity, there is shown in FIGS. 1 and 2 a glow discharge starter 10 which is provided with a glow bottle 11 having an hermetically sealed envelope 12 containing an ionizable medium. The ionizable medium may comprise an inert gas or combinations thereof at a low pressure typically within the range of from about 12.0 torr to about 18.0 torr. A bimetallic electrode 14 and a counter electrode 16 are located within envelope 12 and sealed in glass bead 18. Electrodes 14 and 16 are electrically connected to or as illustrated in FIG. 1, formed from lead-in conductors 22 and 24, respectively. As best shown in FIG. 1, bimetallic electrode 14 includes a post 39 and a bimetallic element 32. Bimetallic element 32 includes a free end 30 and consists of two strips of metal having different linear coefficients of expansion welded together. The side of lower expansion is formed of a nickel-steel alloy while the side of higher expansion is formed of chrome iron. In the embodiment in FIG. 1, the side of higher coefficient of expansion is on the outside (i.e., the side away from counter electrode 16) such that the free end 30 of bimetallic element 32 engages counter electrode 16 upon flexure of bimetallic element 32. The other end of bimetallic element 32 is secured to post 39 by welding.

Further included in glow bottle 11 is a getter holder 40 (FIG. 1) which is formed in bimetallic element 32. The getter holder may contain, for example, zirconium 33 or a mixture of barium, magnesium and thorium. Alternatively, a separate getter holder may be secured to one of the electrodes and comprise a getter holder strip having a getter cup formed therein or secured thereto.

To provide stable reclosure and non-reclosure voltages during the life of the glow bottle, all of the nickel-containing portions of the electrodes exposed to the discharge may by completely covered with a silver plating in accordance with the teachings of U.S. Ser. No. 156,123, now U.S. Pat. No. 4,843,282 which was filed Feb. 16, 1988 and is assigned to the same Assignee as the present Application. By "completely" is meant that the coating is continuous and does not contain voids. Preferably, the bimetallic electrode and the counter electrode are formed from nickel-containing alloys and the silver plating completely covers the electrodes which include post 39, bimetallic element 32 and counter electrode 16. The thickness of the silver plating is from about 0.0002 inch to about 0.0004 inch.

The counter electrode 16 in FIGS. 1 and 2 may be constructed as a second bimetallic electrode and comprise a second post and bimetallic element. The bimetallic element may also vary from what is shown in FIGS. 1 and 2 by being bent in the shape of a U.

Glow discharge starter 10 further includes a radio frequency suppressing capacitor 44 having a main body 46 and a pair of conductors 48, 50 extending from main body 44 and electrically coupling respective electrodes 14, 16 of glow bottle 11. Main body 46 of capacitor 44 contains a pair of wound metal foils separated by a dielectric element. Preferably, the dielectric element is mylar or silicon impregnated polypropylene. Ceramic capacitors were found to be unreliable.

The conductors 22, 24, 48, 50 of the glow bottle 11 and the capacitor 44 extend to a bottom plate or base 52. At the upper end of this bottom plate these conductors are connected to suitable two studs or pins denoted by 54 and 56. Stud 54 electrically connects together conductors 22 and 48. Conductors 24 and 50 are electrically connected together by stud 56. Glow bottle 11 and capacitor 44 may be enclosed within a container or can 50 which is secured to bottom plate 52 as shown in FIGS. 1 and 2.

When the glow discharge starter is connected across or in parallel with an arc discharge lamp, the glow discharge generated within the glow bottle envelope causes the bimetallic element to bend towards the other electrode. When contact is made to preheat the lamp cathodes, the glow discharge ceases causing the bimetallic element to cool and withdraw from the contacted electrode. When contact is broken, a voltage pulse induced by the induction of the ballast, appears across the electrodes of the lamp thereby initiating an arc discharge within the lamp. If the lamp ignition does not occur after the first voltage pulse, the glow discharge sequence is repeated.

Should the lamp in the circuit fail to ignite, the continuous cycling causes the temperature of the glow bottle starter envelope to reach approximately 80–90 degrees Celsius. If the glow bottle becomes inoperative, for example, as a result of the failure of the bimetallic element to contact the counter electrode, the continuous discharge within the glow bottle may convert from a low current glow discharge to a high current arc discharge. This high current can cause the temperature of the envelope to increase to over 450 degrees Celsius.

In accordance with the teachings of the present invention, main body 46 of capacitor 44 is placed in a thermal relationship with envelope 12 of glow bottle 11 as best illustrated in FIG. 2 so that the main body of the capacitor is responsive to the heat generated by the discharge in the discharge envelope. The operating temperature of the capacitor is chosen so that the capacitor will operate properly under normal glow bottle conditions below about 90 degrees Celsius. However, when the above-mentioned maximum abnormal temperature limit (i.e., 400–500 degrees Celsius) is reached, the heat therefrom is conducted through the main body of the capacitor and causes the dielectric therewithin to breakdown resulting in a short circuit between the metal foils of the capacitor. This short circuit within the main body appears across the electrodes of the glow bottle and permanently extinguishes the discharge within the discharge envelope within a relatively short period of time (e.g., 2–3 minutes).

In order to limit the amount of time required to extinguish the glow discharge to quickly reduce the temperature of the discharge envelope, the vertical distance between main body 46 of capacitor 44 and envelope 12 of glow bottle 11 is not greater than about 0.020 inch. Preferably, the discharge envelope and the main body of the capacitor are in a contiguous relationship.

The shortest extinguishing times are achieved when main body 46 of capacitor 44 is longitudinally positioned with respect to glow bottle 11 such that the center P1 (FIG. 2) of main body 46, as measured longitudinally along the main body, is intersected by an imaginary line 58 which extends through the main portion of the glow discharge. This imaginary line 58 is perpendicular to the longitudinal axis of the glow bottle. As best illustrated by P2 in FIG. 1, the main portion of the discharge occurs at a location immediately adjacent and above glass bead 18 where post 39 and counter electrode 16 enter the internal portion of envelope 12.

As to the manufacture of the above-described glow discharge starter, a suitable envelope is first provided. A bimetallic electrode is formed with a bimetallic element and a post. A counter electrode is provided. The bimetallic electrode and the counter electrode may be completely covered with a silver plating having a thickness of from about 0.0002 inch to about 0.0004 inch before the electrodes are sealed within the envelope in the normal fashion. The interior of the envelope is exhausted by connecting the envelope to a vacuum system. The envelope is filled with a gas (e.g., argon) at a predetermined pressure and finally hermetically sealed. A capacitor is provided having a main body and a pair of conductors extending therefrom. Each of the conductors of the glow bottle are connected to a respective conductor of the capacitor. Finally, the main body of the capacitor is positioned with respect to the envelope of the glow bottle so that it is responsive to heat generated in the discharge envelope so as to create a short circuit and thereby extinguish the glow discharge within the discharge envelope when a maximum temperature limit is reached.

In a typical but not limiting example of a glow discharge starter made in accordance with the teachings of the present invention, the envelope of the glow bottle is formed from potash soda lead glass having an outside diameter of 0.285 inch (7.2 millimeters), a wall thickness of 0.027 inch (0.69 millimeter) and an overall length of 1.1 inches (28 millimeters). The post and counter electrode were formed from nickel plated iron. The bimetallic element contained 0.2 percent chromium, 7.4 percent manganese, 19.4 percent nickel and the balance iron. The post, bimetallic element and counter electrode were completely covered with a silver plating with a thickness of approximately 0.0003 inch. The hermetically sealed envelope contained an argon fill at a pressure of 15 torr.

Capacitors manufactured by Alpha and SK Tritronic of Japan having an average capacitance of approximately 0.010 microfarads were used with the above glow bottles to form two groups of starters. The capacitors were capable of withstanding for one minute without breakdown a 60 cycle alternating potential of 1800 volts RMS. The main body of each of the capacitors was touching the envelope of a glow bottle. Also, the main body of the capacitors was longitudinally positioned with respect to glow bottle such that the center of the main body was in line with the main portion of the glow discharge (i.e., immediately above the seal).

Table I below illustrates the minimum and maximum times required for the main body of the capacitor to short circuit and extinguish the discharge within the glow bottle after an abnormal temperature condition was experienced.

TABLE I

| CAPACITOR | TIME FOR CAPACITOR TO SHORT | |
|---|---|---|
| | MINIMUM | MAXIMUM |
| ALPHA | 1 MIN 27 SECONDS | 1 MIN 54 SECONDS |
| SK TRITRONIC | 1 MIN 04 SECONDS | 1 MIN 28 SECONDS |

There thus has been shown and described an improved glow discharge starter having means for quickly extinguishing the discharge within the glow bottle envelope when a maximum temperature is reached. The starter is easy to manufacture, does not require additional components, such as a fuse wire or insulation.

While there have been shown and described what are at present considered to be the preferred embodiments of the invention, it will be apparent to those skilled in the art that various changes and modifications can be made herein without departing from the scope of the invention. The embodiments shown in the drawings and described in the specification are intended to best explain the principles of the invention and its practical application to hereby enable others in the art to best utilize the invention in various embodiments and with various modifications as are suited to the particular use contemplated.

What is claimed is:

1. A glow discharge starter comprising an hermetically sealed discharge envelope containing an ionizable medium, a bimetallic electrode and a counter electrode and a capacitor having a main body and a pair of conductors extending from said main body and electrically coupling respective electrodes of said discharge envelope, said main body of the capacitor being in a thermal relationship with said discharge envelope to be responsive to heat generated in said discharge envelope; said capacitor being adapted to create a short circuit within said main body of said capacitor to thereby extinguish the discharge within said discharge envelope when a maximum temperature limit is reached.

2. The glow discharge starter of claim 1 wherein said main body of said capacitor and said discharge envelope are separated by a distance not greater than about 0.020 inch.

3. The glow discharge starter of claim 1 wherein said main body of said capacitor and said discharge envelope are in a contiguous relationship.

4. The glow discharge starter of claim 1 wherein said capacitor has a mylar or silicon impregnated polypropylene dielectric.

5. The glow discharge starter of claim 1 wherein said main body of said capacitor is longitudinally positioned with respect said discharge envelope such that the center of said main body is in line with the main portion of the discharge.

6. A method of manufacturing a glow discharge starter comprising the steps of:

providing a discharge envelope;

forming a bimetallic electrode with a bimetallic element and a post;

providing a counter electrode;

sealing said bimetallic electrode and said counter electrode within said envelope;

exhausting the envelope;

filling said envelope with a gas at a predetermined pressure;

hermetically sealing said envelope;

providing a capacitor having a main body and a pair of conductors extending therefrom;

connecting each of said conductors of said discharge envelope to a respective conductor of said capacitor; and positioning said main body of said capacitor with respect to said discharge envelope so that said main body is responsive to heat generated in the discharge envelope to thereby create a short circuit and extinguish the discharge within said discharge envelope when a maximum temperature is reached.

7. The method of claim 6 including the step of separating said main body of said capacitor and said discharge envelope by a distance not greater than about 0.020 inch.

8. The method of claim 6 including the step of positioning said main body of said capacitor and said discharge envelope in a contiguous relationship.

9. The method of claim 6 including the step of providing a capacitor with a mylar or silicon impregnated polypropylene dielectric.

10. The method of claim 6 including the step of longitudinally positioning said main body of said capacitor with respect to said discharge envelope such that the center of the main body is in line with said main portion of the discharge.

* * * * *